US006863940B2

(12) United States Patent
Silver et al.

(10) Patent No.: US 6,863,940 B2
(45) Date of Patent: Mar. 8, 2005

(54) WEATHERPROOF SHEETS FOR COPYING, PRINTING AND WRITING AND METHODS RELATED THERETO

(75) Inventors: Scott E. Silver, Fox Island, WA (US); Todd D. Silver, Tacoma, WA (US); Dennis Oscar, West Bend, WI (US)

(73) Assignee: J.L. Darling Corporation, Tacoma, WA (US)

( * ) Notice: Subject to any disclaimer, the term of this patent is extended or adjusted under 35 U.S.C. 154(b) by 42 days.

(21) Appl. No.: 10/024,633

(22) Filed: Dec. 17, 2001

(65) Prior Publication Data

US 2003/0113565 A1 Jun. 19, 2003

(51) Int. Cl.[7] ..... B41M 5/00

(52) U.S. Cl. ..... 428/32.5; 428/32.39; 428/211.1; 428/488.11; 503/227

(58) Field of Search ..... 428/206, 211.1, 428/195.1, 195, 32.39, 32.5, 488.11; 503/200, 227

(56) References Cited

U.S. PATENT DOCUMENTS

| | | | | | |
|---|---|---|---|---|---|
| 3,983,268 | A | | 9/1976 | Scharf et al. | 427/341 |
| 4,336,297 | A | * | 6/1982 | Fushiki et al. | 428/507 |
| 4,931,359 | A | * | 6/1990 | Yagi et al. | 428/325 |
| 5,139,614 | A | | 8/1992 | dePierne et al. | 162/135 |
| 5,401,562 | A | * | 3/1995 | Akao | 428/211 |
| 5,413,867 | A | * | 5/1995 | Chang et al. | 428/447 |
| 5,660,919 | A | | 8/1997 | Vallee et al. | 428/206 |
| 5,762,799 | A | | 6/1998 | Dadea | 210/508 |
| 5,891,552 | A | * | 4/1999 | Lu et al. | 428/195 |
| 5,919,552 | A | * | 7/1999 | Malhotra | 428/195 |
| 6,028,028 | A | * | 2/2000 | Nitta | 503/200 |
| 6,087,457 | A | | 7/2000 | Tsai | 526/72 |
| 6,140,412 | A | * | 10/2000 | Saitoh et al. | 524/591 |
| 6,391,954 | B2 | * | 5/2002 | Azizi et al. | 524/306 |
| 6,596,805 | B1 | * | 7/2003 | Nigam et al. | 524/527 |
| 6,677,006 | B2 | * | 1/2004 | Otani et al. | 428/32.25 |

FOREIGN PATENT DOCUMENTS

| | | |
|---|---|---|
| FR | 2365002 | 7/1981 |
| GB | 1593331 | 7/1981 |
| JP | 2000-80595 | 3/2000 |

OTHER PUBLICATIONS

Abstract of JP 56–148997, CAPLUS Accession No. 1982:124832, Nov. 18, 1981.
Abstract of JP 2000–80595, espacenet database, Mar. 21, 2000.

* cited by examiner

*Primary Examiner*—Bruce H. Hess
*Assistant Examiner*—Tamra L. Dicus
(74) *Attorney, Agent, or Firm*—Seed IP Law Group PLLC

(57) ABSTRACT

Weatherproof sheets, suitable for conventional printing, writing, photocopying, and laser printing, are prepared by impregnantly coating a cellulosic substrate on at least one side with a durable weatherproofing composition that is water-based. The composition that is used for general-purpose weatherproof sheets comprises a styrenic acrylic copolymer, a wax, a filler for blocking resistance, a filler for tooth, and a pigment. The preparation of all-purpose weatherproof sheets, usable in photocopiers and laser printers, is made possible by substantially omitting calcium carbonate and titanium dioxide from the composition. The weatherproof sheets resist falling apart, remain legible, and can be written upon when wet. They are also non-yellowing, biodegradable and recylclable. Also, disclosed are methods for making the weatherproof sheets, as well as weatherproof sheets made by those methods.

20 Claims, No Drawings

WEATHERPROOF SHEETS FOR COPYING, PRINTING AND WRITING AND METHODS RELATED THERETO

BACKGROUND OF THE INVENTION

1. Field of the Invention

The present invention relates to cellulosic substrates, such as paper sheets, that are rendered water resistant and useful for photocopying, printing, and writing, by coating with a chemical composition, as well as to methods for making such products, and to products made by such methods.

2. Description of the Related Art

Various methods are known for treating paper to make it liquid-repellant or liquid-proof, or to enhance its wet-strength. Often, the liquid of interest is water or an aqueous solution. Paper has been made water-repellent, that is, resistant to wetting, most often to prevent spreading or "feathering" of ink applied to the paper. This is commonly referred to as "sizing." Paper, such as that used for milk and juice containers, has been rendered waterproof by providing an impermeable barrier in the form of a film or coating that may cover the pores of the paper, as well as the fibers. The wet-strength of paper, such as that used for tissue, paper towels, and filters, has also been enhanced, generally by providing interfiber bonds that are more resistant to attack by water, rather than preventing water from permeating paper fibers.

Generally, it is advantageous to provide water resistance to paper used for printing or writing by coating or impregnating a surface with a suitable material. Such a method allows the use of a variety of stock papers already available from paper manufacturers.

A number of known methods for treating paper to render it more water-repellent, are concerned with paper sizing. Surface sizing is the application of a non-pigmented sizing agent as a coating to the surface of paper, while internal sizing entails the addition of sizing agents to paper pulp before it is formed into sheets. In addition to referring to a method for smoothing a paper surface and delaying or preventing the absorption and feathering of liquids, such as printing and writing inks, applied thereon, sizing may also, as one example, refer to a method for coating milk carton stock to prevent any fluid flow through its walls and edges.

Various compositions have been described as suitable for surface sizing. U.S. Pat. No. 6,290,814 B1 suggests surface sizing paper using a combination of gellan gum (a heteropolysaccharide) and derivatized starch, as an improvement over older methods using agents such as polyvinyl alcohol, starch, or styrene acrylic emulsions, among others. Surface sizing using an aqueous dispersion of a copolymer derived from at least one monomer of styrene or a styrene derivative, at least one monomer of an ester of ethylenically unsaturated carboxylic acids and alkanols such as $C_1$–$C_4$ alkyl acrylates and $C_1$–$C_4$ alkyl methacrylates, and at least one monomer of an ethylenically unsaturated carboxylic or sulfonic acid or salt thereof, is described by U.S. Pat. No. 6,087,457 as superior to surface sizing using polymer dispersions prepared from emulsion polymerization of styrenic monomers with alkyl (meth)acrylates. U.S. Pat. No. 5,139,614 discloses a polymer made from styrene and methacrylic acid for use in sizing paper to provide it with resistance to penetration of ink and aqueous liquids. U.S. Pat. No. 3,983,268 describes surface sizing paper by impregnating it with an aqueous solution containing a water soluble salt of a random copolymer based on styrene and a comonomer selected from acrylic acid, $C_{1-4}$ alkyl esters of acrylic acid and methacrylic acid.

The above methods are concerned with rendering printing and writing paper sufficiently water-repellant so that there is minimal feathering of applied ink, thus allowing for more sharply printed or written lines. Generally, however, paper that is useful for machine printing, writing, or photocopying, and prepared by the above methods is not sufficiently water-repellant or waterproof so as to remain intact and legible when wet or provide a surface that, under wet conditions, can be written upon with pen or pencil.

Paper has been treated so as to not readily disintegrate when wet. As an example, a method for making waterproof photographic paper is known where a polyolefin composition is applied to both sides of the paper by extrusion coating. This method is described in U.S. Pat. No. 4,820,582 as one way to protect photographic paper from penetration by water and aqueous processing solutions. The aforementioned patent also recognizes the need to protect the edges of the paper from such penetration and suggests solving the problem by internally sizing the paper with a hydrophobizing agent comprising alkylketene dimers. However, photographic paper is generally not suitable as a substrate for writing with pen or pencil, for printing, or for photocopying.

Another example of paper that is highly resistant to disintegrating when wet is filter paper. U.S. Pat. No. 5,762,799 describes a method for making filter paper having water repellency, wherein the paper is impregnated with a copolymer based on n-butylacrylate-styrene. Again, however, such paper is not suitable as ordinary writing or printing paper, or as paper that can be used in photocopiers or laser printers.

Additionally, treatments have been described for imparting a degree of water-repellency to printable paper, sufficient to allow its use for security documents and currency. U.S. Pat. No. 5,660,919 describes making printable sheets for bank notes and other valuable securities by treating at least one side with a composition comprising at least one filler and at least one elastomeric binder that is an aqueous dispersion having polyurethane, acrylate copolymers and, optionally, carboxylated styrene-butadiene copolymers and polymers having acrylonitrile, isoprene, or neoprene monomers. The above methods, however, are not directed to paper that provides a surface for writing with pen or pencil in a wet environment, or that can be used in laser copiers or photocopiers and then used in wet environments.

A number of other methods are known for treating paper surfaces to provide water resistance thereto. U.S. Pat. No. 4,537,595 describes spraying paper with an aqueous solution of sodium sulfide and an organopolysiloxane with Bunte salt groups, or with an emulsion of hydrogen siloxane followed by heating, to durably hydrophobize the paper. U.S. Pat. No. 6,054,020 describes applying amine-modified polysiloxanes to the outer surface of a tissue product to provide some degree of water or liquid repellency. One method for providing a moisture-proof coating on paper, while allowing the paper to be easily repulped and recycled is found in U.S. Pat. No. 5,695,608. The moisture-proof, film-forming synthetic resin used comprises plate crystalline phyllosilicate compound particles and a moisture-proofness enhancing agent such as organoalkoxysilane or polyamide polyurea compounds. The patent noted that it was well known that permeation of water in paper could be prevented by applying a coating layer of a hydrophobic film-forming resin such as polyethylene, polypropylene, and polyvinylidene chloride, but that such paper could not be repulped and recycled.

Methods that use wax to produce moisture-proof paper are also known. Japanese unexamined patent pub. No.50-

36,711 describes such a method where paper is coated with an aqueous emulsion containing paraffin wax and then dried under heat. Japanese unexamined patent pub. No.56-148,997 discloses a composition used to moisture-proof paper sheets comprising a synthetic hydrocarbon resin and wax in water. U.S. Pat. No. 2,453,380 describes treating the inside of cardboard containers with latex, wax, and zinc stearate or oxide as a filler. Japanese unexamined Pat. Pub. 2000-80595, in describing a method for making water resistant printing paper by coating with a dispersion of a copolymer based on styrene and alkyl acrylate ester, mentions that mixtures of styrene acrylic resin and paraffin type wax have also been used.

So-called "barrier papers" that are resistant to water are the subject of U.S. Pat. No. 5,330,622. That patent, in recognizing that it was known to coat paper with latex-based compositions, cited French patent appl. A-2 365 002, which describes treating paper to make it water resistant by coating it with a composition having equal amounts of acrylostyrene latex and an aqueous dispersion of a metal salt such as calcium stearate. European patent appl. A-0 187 673 describes impregnating paper with a composition based on PVOH associated with an aldehyde such as glyoxal. U.S. Pat. No. 5,330,622 is directed to providing hydrophobic, oleophobic, and solvanophobic barrier properties to paper by impregnation with a composition comprising glyoxal, dimeric alkylketen, and a fluorinated salt. U.S. Pat. No. 4,110,155 also describes rendering paper waterproof by extrusion coating thereon or adhesively laminating thereto synthetic films such as polyolefins, polyesters, polyamides, and cellulose esters.

Various methods for using silicone-based materials to render paper more water resistant are known. U.S. Pat. No. 3,481,829 suggests using a hydrophobic organo-silicone such as a curable epoxy silicone resin prepared and applied as an aqueous emulsion. U.S. Pat. No. 3,085,902 discloses coating paper with colloidal silica and silicones to make it more water repellent. The colloidal silica is added to either the pulp or paper surface to increase silicon pickup. The paper is then coated with silicone as a water emulsion or solvent system. U.S. Pat. No. 2,507,200 claims to prepare highly water repellent paper by applying to its surface water soluble siliconates, such as alkali siliconates, then drying. The aforementioned patent characterizes this method as an improvement to older methods such as that described in U.S. Pat. No. 2,306,222 for waterproofing paper by contacting it with an organosilicon halide in vapor form, followed by contact with an alkaline reagent (i.e. ammonia) to neutralize the acid generated.

None of the above methods are directed to providing a paper for writing or printing that can, not only remain intact, but also maintain a surface that can be legibly written upon with pen or pencil under extreme wet conditions. Nor are any of the above methods directed to providing such paper than can also be used in photocopiers and laser copiers. Nor do any of the above methods provide a method for coating a wide variety of available, stock papers for writing or printing to impart thereto such characteristics.

A writing paper that can be written upon with an all-weather pen or pencil under wet conditions, and that can withstand prolonged exposure to such conditions without disintegrating has been provided in the past by the J. L. Darling Corporation of Tacoma, Wash. The weatherproof paper was prepared by coating stock writing paper with a proprietary solvent-based coating comprising a vinyl toluated alkyd resin.

There are a number of disadvantages, however, associated with using solvent-based materials for such applications. The cost of using solvent-based materials has greatly increased, largely owing to more strict environmental regulations, promulgated in recent years. Solvents require special handling and storage. Costly equipment is needed to recover or otherwise capture evaporated solvents, which are generally toxic. Longer, more expensive ovens may be needed for a more gradual drying process that avoids creating explosive mixtures. The cost of disposing of toxic and noxious solvent waste products can be considerable. Also, paper coated with solvent-based materials is generally not suitable for use in laser copiers or photocopy machines and, in many instances, is not repulpable or recyclable.

Accordingly, there remains a need in the art for paper that has been coated or otherwise treated with water-based materials to thereby render the paper usable under substantially wet conditions, such as might be encountered in areas exposed to inclement weather, where the paper can be repulped and recycled. More particularly, there remains a need in the art for such paper that maintains, when wet, a surface sufficiently intact and undisturbed so as to continue to legibly bear machine printed or written images. There also remains a need in the art for such paper having a surface that can be written upon with pen or pencil under wet or dry conditions. Further, there remains a need in the art for paper having such properties that is also usable as photocopy or laser printer paper. The paper should also be repulpable and recylable. Finally, there remains a need in the art for methods that can provide paper having the above-described properties by coating a number of commercially available paper stocks with water-based materials capable of imparting the requisite water resistance. The present invention fulfills these needs and provides further related advantages.

BRIEF SUMMARY OF THE INVENTION

In brief, the present invention is directed to weatherproof sheets, such as printing, writing, photocopy and laser printer paper, as well as to methods used to make the weatherproof sheets and weatherproof sheets made by those methods.

In one embodiment, the present invention is directed to a general-purpose weatherproof sheet that is a substantially planar cellulosic substrate, such as a sheet of paper, where the substrate is impregnantly coated on at least one side with a composition that, thereby, provides a durable weatherproofing coating layer. The composition comprises a copolymeric resin derived from styrenic and acrylic monomers, as well as a wax, such as paraffin wax; a filler to provide block resistance, such as barium sulfate; a filler, such as calcium carbonate, to provide tooth to the surface of the sheet; and a pigment, such as titanium dioxide to provide a white color to the sheet. It has been surprisingly found that a variety of cellulosic substrates, such as various commercially available paper stocks, when so coated, can be machine printed with ink, or can be written upon with all-weather pen or pencil, and subjected to prolonged exposure to a wet environment without disintegrating or becoming illegible. It has also been surprisingly found that one can write directly upon the coating with an all-weather pen or pencil under both wet and dry conditions, even when the content of the wax in the coating is sufficient to cause water to bead up on the surface of the coating. The general-purpose weatherproof sheet is not, however, suitable for use in photocopiers and laser printers.

The present invention, in another embodiment, is directed to an all-purpose weatherproof sheet that can be used in photocopiers and laser printers. The weatherproof sheet of this embodiment is also a substantially planar cellulosic substrate, such as a sheet of paper, where the substrate is impregnantly coated on at least one side with a durable weatherproofing composition. The composition comprises a styrenic acrylic resin, a wax, and barium sulfate, but contains substantially no calcium carbonate or titanium dioxide. It has been surprisingly found that such coated sheets can be used in photocopiers and laser printers to create printed weatherproof sheets, without fouling, damaging, or otherwise adversely affecting the smooth operation of such equipment. This has surprisingly been found to be the case, even when large volumes of such weatherproof sheets are run through photocopiers or laser printers. This result has been obtained for a variety of cellulosic paper sheets, where the sheets are dimensionally suitable for use in photocopiers and laser printers and are coated on one or both sides with the above composition that is substantially devoid of calcium carbonate or titanium dioxide. The above weatherproof sheets are also non-yellowing, biodegradable and recyclable.

Other embodiments are directed to methods of making weatherproof sheets, where a sheet comprises a cellulosic substrate, such as a sheet of paper, having at least one side impregnantly covered with a durable weatherproofing coating. In one embodiment, a method is disclosed for making a general-purpose weatherproof sheet that is machine printable or can be written upon while wet or dry using an all-weather pen or a pencil, but is not suitable for use in photocopiers or laser printers. The method comprises the steps of providing a suitable cellulosic substrate, impregnantly applying to at least one side of the substrate an aqueous weatherproofing composition, and drying the applied composition to remove most of the water and, thereby, form a durable weatherproofing coating.

In a particular embodiment, the aqueous composition comprises an emulsified styrenic acrylic copolymer or mixture of copolymers, an emulsified paraffin wax, barium sulfate as a filler to provide block resistance, calcium carbonate as a filler to provide tooth for printability and writablility, and titanium dioxide as a pigment to provide a white color to the sheet. Also, in a particular embodiment, the aqueous composition is applied using a flexographic process, and the cellulosic substrate and aqueous composition impregnantly applied thereon are dried so as to yield a weatherproof sheet having a moisture content of about 3 percent to about 10 percent by weight.

In another embodiment directed to methods, a method is disclosed for making an all-purpose weatherproof sheet that is suitable for use in a photocopier or laser printer. The method of this embodiment comprises the same basic steps as the method described above. However, the aqueous composition differs in that it contains substantially no calcium carbonate or titanium dioxide. Instead, these components are replaced by additional barium sulfate. Also, in a particular embodiment, the cellulosic substrate and aqueous composition impregnantly applied thereon are dried so as to yield a weatherproof sheet having a moisture content of about 4 percent to about 7 percent by weight.

Finally, additional embodiments of the present invention are directed to weatherproof sheets made by the methods described above, as well as by other methods of more particular embodiments disclosed herein.

These and other aspects of this invention will be evident upon reference to the following detailed description of the invention.

DETAILED DESCRIPTION OF THE INVENTION

As noted above, the present invention is generally directed to weatherproof sheets, useful as surfaces for printing and writing, as well as to methods used to make the weatherproof sheets, and to the latter made by those methods. For all embodiments directed to the product, the weatherproof sheet is a cellulosic substrate, such as printing, writing, photocopy, and laser printer paper, impregnantly coated on at least one side with a durable weatherproofing material.

As used herein, the term "weatherproof" means sufficiently water resistant that the above sheet, despite prolonged exposure to a wet environment, such as one created by substantial rainfall, retains its utility as a surface for legibly bearing machine printed or written images, or as a surface that can be written upon when wet or dry, using pen or pencil. More specifically, this means that, not only does the sheet resist falling apart when wet, but maintains a substantially intact and undisturbed surface. The weatherproof character of the sheet is largely a function of water repellency and wet strength. Water repellency refers to the ability of the sheet to resist wetting, that is, the passage of water into the structural components of the sheet through capillary action. Wet strength refers to the tensile strength of the sheet when permeated with water, the strength being provided by interfiber bonds resistant to attack by water.

As used herein, the term "general-purpose weatherproof sheet" refers to a weatherproof sheet having all of the above attributes, with the exception that the sheet is not suitable for use in a photocopier or laser printer. Also, as used herein, the term "all-purpose weatherproof sheet" refers to a weatherproof sheet having all of the above attributes that is also suitable for use in a photocopier or laser printer.

In one embodiment, the present invention discloses a general-purpose weatherproof sheet comprising a cellulosic substrate that is substantially planar and impregnantly covered on at least one side with a weatherproofing coating layer. The coating layer comprises a copolymer or mixture of copolymers derived from at least one styrene or styrenic monomer and at least one acrylic monomer, a wax, a filler to provide block resistance, a filler to provide tooth for printability and writability, and a pigment. In a particular embodiment, the copolymer or mixture of copolymers is derived from monomers selected from styrene, butyl acrylate, 2-ethylhexyl acrylate, acrylic acid, or a mixture thereof. In another particular embodiment, the mixture of copolymers is the mixture of copolymers present in Lucidene®605, an emulsion prepared and sold by the Rohm and Haas Company of Charlotte, N.C. ("Rohm and Haas"). In yet another particular embodiment, the coating layer is derived from Rite in the Rain® Formula #22154A, a product manufactured and sold by Northwest Coatings Corp. of Oak Creek, Wis. ("NW Coatings").

A cellulosic substrate is one that comprises cellulosic fibers. A typical example of such a substrate is cellulosic paper. Cellulosic paper may comprise fibers such as wood fibers, cotton fibers, as well as other cellulosic fibers, including recycled cellulosic fibers. Particular embodiments are directed to paper as the cellulosic substrate. The cellulosic substrate is said to be impregnantly covered with a coating layer, when the coating layer penetrates the surface of the substrate to at least some degree.

The copolymer may be a block or random copolymer. An example of a styrenic monomer is a monomer of substituted styrene. Some examples of acrylic monomers are acrylic acid, methacrylic acid, and esters of acrylic acids and methacrylic acids, such as methyl methacrylate. Such copolymers may be synthesized by methods well known in the art, for example, by emulsion copolymerization. A number of such methods, as well as copolymers obtained by those methods, are disclosed in the publications previously cited. The publications are incorporated herein by reference in their entirety.

A filler to provide block resistance refers to an additive included in the coating layer to prevent surfaces in contact in a stack of weatherproof sheets, or in a roll of weatherproof sheet material, from sticking together. A filler to provide tooth for printability and writability refers to an additive included in the coating layer to impart to its surface a degree of texture or roughness required for printability or writability.

In a specific related embodiment, the weight of the coating layer ranges from about 5.6 grams to about 8.5 grams per square meter of the cellulosic substrate surface area covered. In other specific related embodiments, respectively, the amount of the copolymer or mixture of copolymers ranges from about 30 percent to about 63 percent, while the amount of the wax ranges from about 1.5 percent to about 9.5 percent; and the amount of the copolymer or mixture of copolymers is about 50%, while the amount of the wax is about 2.5 percent, where the recited amounts are based on the total weight of the coating layer and the coating layer having a moisture content of 5 percent by weight.

The amount of the wax is such that water beads up on a coating layer surface that is also printable and writable. If the amount of the wax is too great, it is difficult to write or print on the surface. If there is not enough wax in the coating layer, then water does not bead up on the coated surface, and that desirable characteristic for the product is not obtained. In addition to providing water resistance and causing water to bead up on the coating layer surface, the wax also provides block resistance and scratch/mar resistance. In one embodiment, the wax is paraffin wax, a polypropylene-wax mixture, a polyethylene-wax mixture, carnauba wax, microcrystalline wax, montan wax, a Fisher-Tropsch wax, beeswax, or a mixture thereof.

In various embodiments, the filler to provide block resistance comprises barium sulfate, the filler to provide tooth comprises calcium carbonate, and the pigment comprises titanium dioxide, respectively. The amount of barium sulfate, in one embodiment, ranges from 0 percent to about 65 percent, based on the total weight of the coating layer and the latter having a moisture content of 5 percent; and, in a particular embodiment, the amount of the barium sulfate, on the same basis, is about 17 percent. In another embodiment, the filler to provide block resistance is clay, mica, aluminum trihydrate, or a mixture thereof.

This use of barium sulfate and calcium carbonate is known. Also known, is the use of titanium dioxide as a pigment to add both opacity and whiteness to paper products. Weatherproof sheets having a color other than white are also disclosed. The color may be obtained by providing a colored cellulosic substrate, or by providing a color tinting agent in the coating layer, where the agent comprises an organic or inorganic pigment dispersed in an acrylic resin or other suitable media.

The weatherproof nature of the above sheet is enhanced, in one embodiment, by including an additive, such as a polyamide, to increase the wet strength of the cellulosic substrate. The additive is included as a component of the cellulosic substrate.

It has been surprisingly found that cellulosic substrates, when treated as described above, yield sheets that are weatherproof and that can bear printing applied by conventional printing methods such as lithography, screen printing, letter press, flexography, and rotgravure. However, the general-purpose weatherproof sheets are not suitable for use in photocopiers and laser printers. Also, the weatherproof sheets can be written upon using a pencil or an all-weather pen, even when the surface is wet. Accordingly, other aspects of the present invention include weatherproof sheets bearing images printed directly onto the coating layer, as well as books and notepads comprising a plurality of the sheets intended for use outdoors or in otherwise wet environments. Further, the weatherproof sheets of the above-disclosed embodiments are non-yellowing, biodegradable, repulpable and recyclable.

In another embodiment, the present invention is directed to an all-purpose weatherproof sheet, that is, a weatherproof sheet that is also suitable for use in a photocopier or laser printer. The all-purpose weatherproof sheet of this embodiment, as is the case for the general-purpose weatherproof sheets disclosed above, comprises a cellulosic substrate that is substantially planar and impregnantly covered on at least one side with a durable weatherproofing coating layer. Also, as before, the coating layer comprises a copolymer or mixture of copolymers derived from at least one styrene or styrenic monomer and at least one acrylic monomer, a wax, a filler to provide block resistance, a filler to provide tooth for printability and writability, and a pigment. However, for this embodiment, the coating layer comprises substantially no titanium dioxide pigment or calcium carbonate filler. Also, the coating layer comprises an optical brightener. In a particular embodiment, the copolymer or mixture of copolymers is derived from monomers selected from styrene, butyl acrylate, 2-ethylhexyl acrylate, acrylic acid, or a mixture thereof. In another particular embodiment, the mixture of copolymers is the mixture of copolymers present in Lucidene®605, an emulsion prepared and sold by Rohm and Haas. In yet another particular embodiment, the coating layer is derived from Clear Rite in the Rain® Formula #22560B, a product manufactured and sold by NW Coatings.

The general-purpose weatherproof paper, comprising titanium dioxide and calcium carbonate, was used in a photocopier and laser printer with the result that the equipment was sometimes able to process the paper and form images thereon. However, the equipment was prone to jamming or otherwise failing to process the paper. That the paper could be used at all in such equipment was an unexpected and surprising result in view of the amount and nature of the styrenic acrylic copolymer resin and wax present in the coating layer. The styrenic acrylic copolymer resins used for the weatherproof sheets of the present invention that were used in photocopiers and laser printers have a low glass transition temperature, $T_g$ (the temperature at which the resin transitions from a glassy amorphous state to a plastic and pliable state). One skilled in the art would expect that such material, especially when present in the quantities used for the weatherproof sheets of the present invention, would quickly gum up a photocopier or laser printer from contacting its approximately 400° F. fuser roller. Surprisingly, this was not found to be the case.

Further, one skilled in the art would also expect that paper coated with enough wax to render paper weatherproof and cause water to bead up on its surface, would not be usable in photocopiers and laser printers. Typically wax melts at a much lower temperature than the approximately 400° F. temperature of the fuser roller in a photocopier or laser printer. Accordingly, one skilled in the art would expect the wax to accumulate on the roller and quickly render the equipment inoperable. Surprisingly, this was not found to be the case, either.

Nevertheless, it was found that the general-purpose weatherproof paper could not be consistently processed in the equipment and, given enough volume of sheets processed, would inevitably foul the equipment. It was discovered that the source of the problem was the presence of the titanium dioxide and calcium carbonate. When these components were removed from the coating layer, it was surprisingly found that on the order of 100,000 of the resulting all-purpose weatherproof sheets could be processed in a photocopier or laser printer without adversely impacting its operation. Accordingly, as used in describing this embodiment of the present invention with regard to specifying the quantity of titanium dioxide or calcium carbonate present in the coating layer, the term "substantially no," means either none of these components, or a quantity that is small enough so that a large volume of weatherproof sheets can be processed in a photocopier or laser printer without fouling, or otherwise adversely impacting its operation.

In a related embodiment, barium sulfate is used as the filler providing block resistance, as the filler providing tooth, and as the pigment. It was unexpected and surprising that, after elimination of the calcium carbonate from the coating layer, the presence of barium sulfate alone, in conjunction with the copolymer and wax in the coating layer, was able to impart enough tooth for the surface to have sufficient printability and writability. Also, because barium sulfate can serve as both a filler and a pigment, enough opacity and whiteness was obtained after elimination of the titanium dioxide by selecting a suitable paper substrate, using an optical brightener, and using the barium sulfate. The amount of barium sulfate, in one embodiment, ranges from 0 percent to about 65 percent, based on the total weight of the coating layer and the latter having a moisture content of 5 percent; and, in a particular embodiment, the amount of the barium sulfate, on the same basis, is about 38 percent. In another embodiment, the filler to provide block resistance is clay, mica, aluminum trihydrate, or a mixture thereof.

In a related specific embodiment, the weight of the coating layer ranges from about 3.7 grams to about 5.6 grams per square meter of cellulosic substrate surface area covered. In other specific related embodiments, respectively, the amount of the copolymer or mixture of copolymers ranges from about 30 percent to about 82 percent, while the amount of the wax ranges from about 1.5 percent to about 13 percent; and the amount of the copolymer or mixture of copolymers is about 52.5 percent, while the amount of the wax is about 2.7 percent, where the recited amounts are based on the total weight of the coating layer and the coating layer having a moisture content of 5 percent by weight. As before, the amount of wax is selected so that water beads up on a coating layer surface that is also printable and writable.

In further related embodiments, respectively, the cellulosic substrate further comprises an additive, such as polyamide, to enhance its wet strength, and the all-purpose weatherproof sheet is a color other than white. As before, the color may be obtained by providing a colored cellulosic substrate or by providing a color tinting in the coating layer, where the agent comprises an organic or inorganic pigment dispersed in an acrylic resin or other suitable media.

The moisture content of the weatherproof paper of the instant invention for use in a photocopier is pertinent to the operation of the machine. For example, it has been found that, if the water content is too high, the paper will gum up the machine. If the water content is too low, the paper is too brittle to use in the machine and will cause it to jam. Accordingly, in another embodiment directed to an all-purpose weatherproof sheet for use in photocopiers and laser printers, the moisture content of the sheet ranges from about 4 percent to about 7 percent, by weight of the sheet.

In a further related embodiment, the thickness of the cellulosic paper substrate used for the weatherproof photocopy paper ranges from 0.003 inches to 0.013 inches. This is the range of thickness that ordinarily can be processed by a photocopier or laser printer. In a yet further related embodiment, the thickness of the cellulosic paper substrate ranges from 0.004 inches to 0.006 inches. This is a range of thickness that is particularly desirable for large format architectural and construction drawings. Finally, another related embodiment is directed to an architectural or construction drawing prepared by printing the drawing onto the all-purpose weatherproof paper of the instant invention using a large format photocopier or laser printer, where the paper has dimensions suitable for such large format printing.

The all-purpose weatherproof sheets of the above-disclosed embodiments are also non-yellowing, biodegradable, repulpable and recyclable.

In another aspect, the present invention is directed to a method of making a general-purpose weatherproof sheet comprising the steps of: (1) providing a substantially planar cellulosic substrate, (2) impregnantly applying to at least one side of the substrate, as a coating, an aqueous composition, and (3) drying the substrate having the aqueous composition applied thereto to form a coating layer having a desired water content. The aqueous composition comprises an emulsified copolymer or mixture of copolymers derived from at least one styrene or styrenic monomer and at least one acrylic monomer, an emulsified wax, a filler to provide block resistance, a filler to provide tooth, and a pigment. In one specific embodiment, the emulsified mixture of copolymers is Lucidene®605, a product prepared and sold by Rohm and Haas. In another specific embodiment, the aqueous composition is Rite in the Rain® Formula #22154A, manufactured and sold by NW Coatings.

In another specific related embodiment, the amount of aqueous composition applied is 2.6 pounds to 3.9 pounds per ream of cellulosic substrate per side. As is understood by those skilled in the art, a ream refers to a quantity of 500 sheets, each sheet being 17 inches wide and 22 inches long. In further specific related embodiments, respectively, the amount of emulsified copolymer or mixture of copolymers ranges from about 40 percent to about 80 percent, while the amount of the emulsified wax ranges from about 3 percent to about 20 percent; and the amount of the emulsified copolymer or mixture of copolymers is about 64 percent, while the amount of the emulsified wax is about 5.3 percent, where the recited amounts are based on the total weight of the aqueous composition. Again, the amount of the emulsified wax is selected so that water beads up on a coating layer surface that is also printable and writable.

In further related embodiments, respectively, the filler to provide block resistance comprises barium sulfate present in an amount ranging from 0 percent to about 40 percent by weight of the aqueous composition, the filler to provide tooth comprises calcium carbonate present in an amount ranging from about 0 percent to about 10 percent by weight of the aqueous composition, and the pigment comprises titanium dioxide present in an amount ranging from about 5 percent to about 15 percent by weight of the aqueous composition.

The aqueous composition, in another related embodiment, is impregnantly applied to the cellulosic substrate as a coating by a method that uses a flexographic process, rotogravure, an air knife, a knife coat, a reverse doctor, a Meyer rod, immersion, spray, or roll nip. Such processes are generally known to those skilled in the art. An example of a flexographic process of this embodiment is one that employs a series of rotating cylinders that pick up, transfer and apply the aqueous composition to the substrate. An enclosed doctor blade meters the coating onto a textured anilox roller that, in turn, transfers the coating to a variable speed printing sleeve. The latter imprints the aqueous composition onto a moving web of the cellulosic substrate. The coating weight is computer monitored to maintain consistency.

The coated cellulosic substrate is dried, in another related embodiment, using an infrared drier and air knife so as to yield a general-purpose weatherproof sheet having a moisture content ranging from about 3 percent to about 10 percent by weight of the weatherproof sheet. A moisture content that is too low will result in the weatherproof sheet being too brittle. A moisture content that is too high can result in curling, blocking, a gummy coating layer, and other undesirable characteristics.

In another related aspect, the present invention is directed to a general-purpose weatherproof sheet made by the above method.

The present invention is also directed to a method of making an all-purpose weatherproof sheet suitable for use in a photocopier or laser printer, the method comprising the same basic steps as those of the above-described method. Also, the related specific embodiments parallel those of the method above, with some exceptions. For the method of this embodiment, the impregnantly applied aqueous composition comprises substantially no calcium carbonate filler or titanium dioxoide pigment. In specific embodiments, respectively, the amount of emulsified copolymer or mixture of copolymers ranges from about 40 percent to about 80 percent, while the amount of the emulsified wax ranges from about 3 percent to about 20 percent; and the amount of the emulsified copolymer or mixture of copolymers is about 67 percent, while the amount of the emulsified wax is about 5.5 percent, where the recited amounts are based on the total weight of the aqueous composition. As before, the amount of the emulsified wax is selected so that water beads up on a coating layer surface that is also printable and writable.

Also, in particular embodiments, respectively, the aqueous composition is Clear Rite in the Rain® Formula #22560B, manufactured and sold by NW Coatings; the amount of aqueous composition applied ranges from 1.7 to 2.6 pounds per ream per side; and the aqueous composition is impregnantly applied by a method that uses a flexographic process, rotogravure, an air knife, a knife coat, a reverse doctor, a Meyer rod, immersion, spray, or roll nip. As before, in a related embodiment, the emulsified mixture of copolymers is Lucidene ®605, a product prepared and sold by Rohm and Haas.

Further, in another particular embodiment, barium sulfate is used as the filler to provide block resistance, as the filler to provide tooth, and as the pigment, where the amount of barium sulfate, in one embodiment, ranges from 0 percent to about 40 percent, and the amount, in another embodiment, is about 23 percent. The recited amounts are based on the total weight of the aqueous composition. Finally, in yet another particular embodiment, the drying step is carried out using infrared dryers and air knives so as to yield a weatherproof sheet having a moisture content ranging from about 4 percent to about 7 percent by weight of the weatherproof sheet. By way of illustration, during the drying step, the cellulosic substrate having the aqueous composition applied thereon may be maintained at 200° F. until the desired moisture content is obtained.

In another related aspect, the present invention is directed to a weatherproof sheet, usable in a photocopier and laser printer, made by the method described in the preceding paragraph.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A weatherproof sheet suitable for use in a photocopier or laser printer and capable of fixedly and legibly bearing images printed directly thereon by means of the photocopier or laser printer, the weatherproof sheet comprising:

a cellulosic substrate having two substantially planar sides; and a durable weatherproofing coating layer, in direct contact with and impregnantly covering at least one of the two sides of the substrate, the coating layer penetrating the surface of the at least one of the two sides of the substrate, wherein the coating layer comprises a copolymer or mixture of copolymers derived from at least one styrene or styrenic monomer and at least one acrylic monomer, a wax, a filler to provide block resistance, a filler to provide tooth for printability and writability, a pigment, and an optical brightener; with the proviso that the coating layer comprises substantially no calcium carbonate filler and substantially no titanium dioxide pigment.

2. The weatherproof sheet of claim 1 wherein the copolymer or mixture of copolymers is derived from monomers selected from the group consisting of styrene, butyl acrylate, 2-ethylhexyl acrylate, acrylic acid, and a mixture thereof.

3. The weatherproof sheet of claim 1 wherein the mixture of copolymers is an acrylic or styrene acrylic emulsion.

4. The weatherproof sheet of claim 1 wherein the weight of the coating layer ranges from about 3.7 grams to about 5.6 grams per square meter of cellulosic substrate surface area covered.

5. The weatherproof sheet of claim 1 wherein, based on the total weight of the coating layer and the coating layer having a moisture content of 5 percent by weight, the amount of the copolymer or mixture of copolymers ranges from about 30 percent to about 82 percent, and the amount of the wax ranges from about 1.5 percent to about 13 percent.

6. The weatherproof sheet of claim 1 wherein, based on the total weight of the coating layer and the coating layer having a moisture content of 5 percent by weight, the amount of the copolymer or mixture of copolymers is about 52.5 percent, and the amount of the wax is about 2.7 percent.

7. The weatherproof sheet of claim 1 wherein the filler to provide block resistance comprises barium sulfate, the filler to provide tooth for printability and writability comprises barium sulfate, and the pigment comprises barium sulfate.

8. The weatherproof sheet of claim 7 wherein the amount of the barium sulfate ranges from 0 percent to about 65 percent, based on the total weight of the coating layer and the coating layer having a moisture content of 5 percent by weight.

9. The weatherproof sheet of claim 7 wherein the amount of the barium sulfate is about 38 percent, based on the total weight of the coating layer and the coating layer having a moisture content of 5 percent by weight.

10. The weatherproof sheet of claim 1 wherein the filler to provide block resistance is clay, mica, aluminum trihydrate, or a mixture thereof.

11. The weatherproof sheet of claim 1, further comprising an additive to enhance the wet strength of the cellulosic substrate.

12. The weatherproof sheet of claim 11 wherein the additive comprises polyamide.

13. The weatherproof sheet of claim 1 wherein the wax is paraffin wax, a polypropylene-wax mixture, a polyethylene-wax mixture, carnauba wax, microcrystalline wax, montan wax, a Fisher-Tropsch wax, beeswax, or a mixture thereof.

14. The weatherproof sheet of claim 1 wherein the coating layer further comprises a color tinting agent comprising an organic or inorganic pigment dispersed in an acrylic resin or other suitable media.

15. The weatherproof sheet of claim 1 wherein the coating layer further comprises water and wherein the moisture content associated therewith ranges from about 4 percent to about 7 percent by weight of the weatherproof sheet.

16. The weatherproof sheet of claim 1 wherein the coating layer is a compounded acrylic.

17. The weatherproof sheet of claim 1 wherein the cellulosic substrate is paper comprising cellulosic fibers.

18. The weatherproof sheet of claim 17 wherein the thickness of the paper ranges from 0.003 inches to 0.013 inches.

19. The weatherproof sheet of claim 17 wherein the thickness of the paper ranges from about 0.004 inches to about 0.006 inches.

20. The weatherproof sheet of claim 19 having dimensions of an architectural or construction drawing.

* * * * *